US006744977B2

(12) United States Patent
Choi

(10) Patent No.: US 6,744,977 B2
(45) Date of Patent: Jun. 1, 2004

(54) ELECTRIC HEATER WITH PREVENTION PLATE ON BACK-REFLECTION DOME

(75) Inventor: Gun-Young Choi, Incheon-shi (KR)

(73) Assignees: Solartech Co., Ltd., Icheon-shi (KR); Key-Young Choi, Incheon-shi (KR)

( * ) Notice: Subject to any disclaimer, the term of this patent is extended or adjusted under 35 U.S.C. 154(b) by 0 days.

(21) Appl. No.: 10/319,706

(22) Filed: Dec. 16, 2002

(65) Prior Publication Data

US 2003/0128972 A1 Jul. 10, 2003

(30) Foreign Application Priority Data

Jan. 8, 2002 (KR) ..... 20-2002-0000532 U

(51) Int. Cl.[7] ..... H05B 3/00
(52) U.S. Cl. ..... 392/428; 392/426; 392/376
(58) Field of Search ..... 392/428, 426, 392/427, 430, 423–425, 376

(56) References Cited

U.S. PATENT DOCUMENTS 1,418,671 A * 6/1922 Patterson ..... 392/428
1,431,184 A * 10/1922 Rose ..... 392/428
4,157,731 A * 6/1979 Denhart ..... 165/55
6,304,719 B1 * 10/2001 Mo ..... 392/376
6,453,121 B2 * 9/2002 Choi ..... 392/376
6,526,227 B2 * 2/2003 Choi ..... 392/422

FOREIGN PATENT DOCUMENTS

GB 862288 * 3/1961 ..... 392/376
KR 1998-061527 U 11/1998
KR 20-0214840 Y1 2/2001
KR 20-0236788 Y1 9/2001

* cited by examiner

*Primary Examiner*—John A. Jeffery
(74) *Attorney, Agent, or Firm*—Smith Patent Office

(57) ABSTRACT

An electric heater with a heat shield plate includes a heating body which is installed at a reflector and heated when electrical power is applied thereto. A safety net is provided which covers a front surface of the reflector and defines a space for accommodating the heating body therein. Further, the heat shield plate is installed at an upper edge of the reflector such that foreign materials are prevented from falling down onto the heating body through the safety net, and a plurality of through-holes are dispersedly formed in the heat shield plate in order to prevent the heat shield plate from being overheated. The heat shield plate includes a curved strap-like plate in which the plurality of through-holes are dispersedly formed, and fixing pieces which extend vertically from the curved plate on one lateral side thereof so that they are coupled to the reflector.

2 Claims, 7 Drawing Sheets

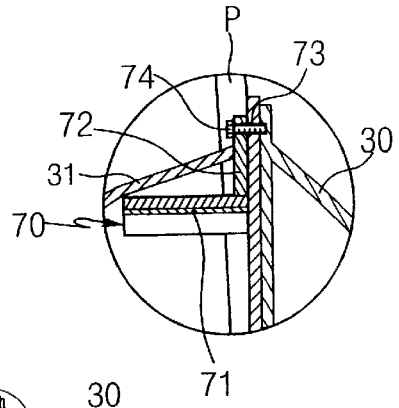
FIG.6 A
PRIOR ART
FIG.6
PRIOR ART
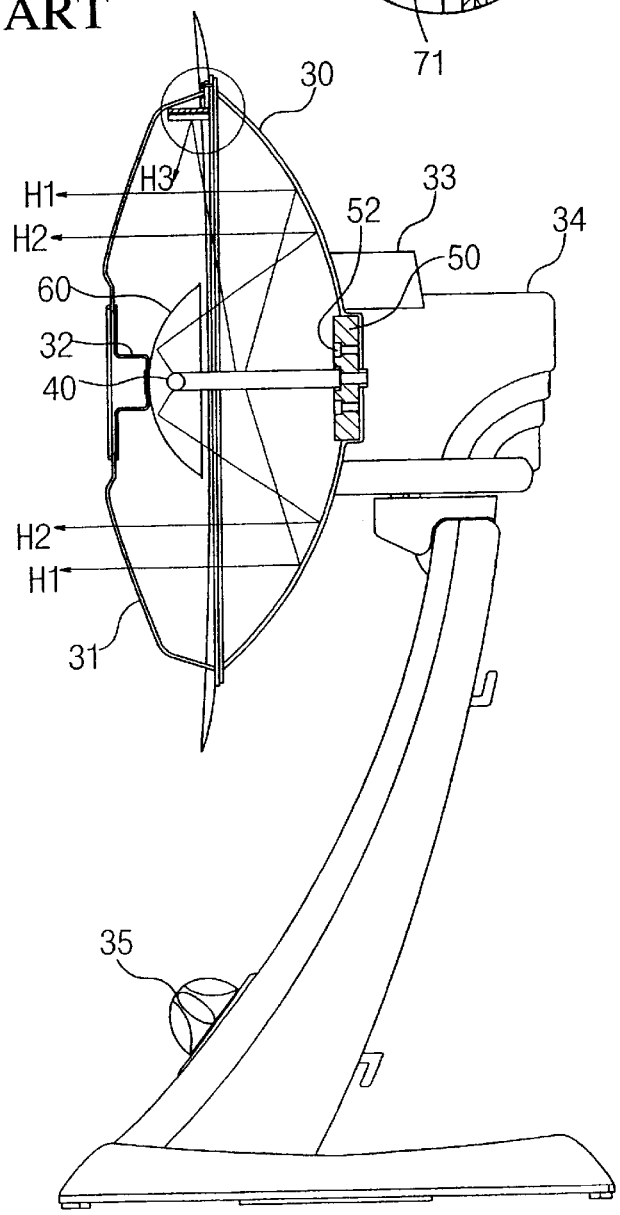

ELECTRIC HEATER WITH PREVENTION PLATE ON BACK-REFLECTION DOME

BACKGROUND OF THE INVENTION

1. Field of the Invention

The present invention relates to an electric heater with a heat shield plate for preventing heat heating rays of the heater and introduction of foreign materials into the heater. More particularly, the present invention relates to an electric heater in which a heat shield plate formed with a plurality of through-holes is installed on a curved plate serving as a reflector to prevent overheat of the electric heater and perform a heat shielding function.

2. Description of the Prior Art

As living standards are improved, a heater as a dominant one of room heating apparatuses has been generally changed from a conventional oil heater to an electric heater. It goes without saying that various kinds of electric heaters have been developed as social demands for the heaters are increased.

As well known in the art, a fundamental operating principle of the electric heater is that ambient air is heated with heat generated when an electric current flows through a heating wire which is placed within a specific space and protected by a safety net. Furthermore, additional means for radiating the heat more efficiently from the heating wire are further installed in the electric heater. As a typical example thereof, a type of electric heater in which a reflector manufactured by curving a substantially rectangular metal sheet to a certain extent is installed behind the heating wire has been spread. However, this electric heater hardly obtains an effect of efficient heat radiation. Such a conventional electric heater has a problem in that a sufficient amount of heat cannot be fully transferred up to a desired distance. In fact, in a case where an amount of electric current is increased so as to increase the amount of heat generated from the heater, there is a risk of overheating and fire. However, if the amount of electric current is reduced in consideration of a safety accident due to the increase of the electric current, it is difficult to obtain the sufficient amount of heat to a desired extent.

In order to solve the problems in the conventional electric heater, a radiant electric heater capable of fully heating room air by transferring an adequate amount of heat as far as possible has been developed and disclosed in Korean Laid-Open Utility Model Publication No. 98-61527.

Such a radiant electric heater is configured in such a manner that a spherical reflector is installed behind a heating wire and a portion to which the heating wire is attached is reduced in diameter in a rearward direction so that heat cannot be diffused in all directions and can be concentrated within a narrow range. Therefore, the heat can be transferred as far as possible. Referring to FIGS. 1 and 2, the electric heater 10 comprises a heat generating unit 10 including a heating wire, and a supporting unit 20 for supporting the heat generating unit.

First, the supporting unit 20 will be described below. A main circuit for operating and controlling the radiant electric heater 1 is installed within a stand 21. Further, a power switch 22 for turning electrical power on or off, a temperature control switch 23 for intermittently turning the electrical power off at a predetermined temperature so that the temperature of the heating wire can be kept to be optimal, a power lamp 24 for indicating whether the electrical power is turned on or off, a safety switch 29 for intermittently turning the electrical power off in accordance with whether the electric heater is tilted, a warning lamp 25 for warning a user when the electric heater is excessively tilted, and the like are arranged at the top and bottom of the stand 21.

Furthermore, the heat generating unit 10 and the stand 21 are connected with each other via first and second posts 26, 27 constructed in such a manner that the second post 27 can be inserted into or put out from the first post 26 after unlocking a control knob 28. That is, a height of the heat generating unit 10 can be arbitrarily adjusted.

In addition, referring to FIG. 2 in which the heat generating unit of the radiant electric heater is shown in an enlarged scale, the heat generating unit 10 comprises the heating wire 12 wound around a heating wire mount 11 of a predetermined shape, the reflector 13 placed behind the heating wire, a safety net 14 connected to the reflector for defining a front contour of the whole heat generating unit 10, and a supporting case 15 connected to a rear end of the reflector 13 for supporting the reflector. Furthermore, the heating wire 12 is connected to the reflector 13 via a bracket 16, and rods 17 for sensing the heat are attached to the front of the reflector at desired positions thereof.

Accordingly, heat rays a from the heating wire 12 are concentrated within the predetermined range by the reflector 13, contrary to the conventional structure in which the heat rays are diffused in all directions. Consequently, the heat generated from the heating wire can reach a position to be heated across a considerable distance. At this time, the heat rays a do not remain in the vicinity of the heat generating unit 10 including the heating wire 12, but are immediately emitted from the heat generating unit through a reflecting process of the reflector 13. Thus, overheating of the safety net 14 can also be prevented.

Here, a phenomenon that the heat rays are concentrated to the utmost can be obtained in a case where the reflector 13 is configured to have a parabolic surface with a central portion thereof being concave and to include a regular spherical surface such as in a general concave mirror.

Moreover, the heating wire mount 11, which is generally made of a heat-resistant material such as ceramic and around which the heating wire 12 is wound, is configured in the form of a truncated cone or a circular cone of which diameter is decreased in a rearward direction so that all the heat rays a from the heating wire 12 are caused to be directed toward the reflector 3 and can thus be prevented from being diffused out of the predetermined range C. At this time, even though the mount 11 is configured in the form of a triangular pyramid or polygonal pyramid rather than the truncated cone, the object of the invention can be sufficiently achieved. That is, any types of mounts 11 of which sectional areas are reduced in the rearward direction may be employed in the invention.

It is apparent that such an electric heater has superior thermal efficiency. However, since the heating wire of the electric heater is made in the form of a coil, the coil may be corroded if it is used for a long time. Thus, there is another problem in that durability in use is deteriorated and risk of fire is increased.

Accordingly, an electric heater disclosed in Korean Utility Model Registration No. 214840 has been developed. The electric heater is configured such that a halogen lamp is used as a heat generating means and a reflector is installed in front of the halogen lamp and fixed to a safety net. FIG. 3 is a front view of the electric heater of the utility model registration, and FIG. 4 is an enlarged sectional view taken along line A—A of FIG. 3. The electric heater of the '840 utility model registration includes a reflector with a heat generating means added thereto and a safety net installed in the formed of the reflector. The electric heater further comprises a halogen lamp fixing plate 50 with a fixing hole 51 (not shown) for allowing electrical power to be supplied to the halogen lamp 40 and fixing the halogen lamp 40 horizontally, an auxiliary reflector 60 installed to correspond to a central bent portion of the halogen lamp 40 for causing heat therefrom to be reflected onto the reflector 30, and a reflector fixture 32 of which one end is connected to the auxiliary reflector 60 and the other end is fixed to a central portion of the safety net 31.

Preferably, the halogen lamp 40 is fixed to the halogen lamp fixing plate 50 with a ceramic material or the like which can be isolated from the reflector 30, and the halogen lamp fixing plate 50 is configured to be in close contact with the reflector 30 so that it cannot hinder heat reflection of the reflector 30. In FIG. 4, reference numeral 52 designates screw holes used for fastening the halogen lamp fixing plate 50 to the reflector 30 with the screws, and reference numeral 33 designates a handle used when carrying the electric heater and preferably formed on an upper surface of a supporting case 34 for supporting the reflector 30 in the rear thereof.

The auxiliary reflector 60 is installed at a front end of the halogen lamp 40 in such a manner that a concave surface thereof is directed toward the reflector 30 so that the heat from the halogen lamp 40 can be reflected onto the reflector 30.

First, the halogen lamp fixing plate 50 is fastened to the reflector 30 by screwing the screws into the screw holes 52. The halogen lamp 40 is then coupled to the halogen lamp plate 50 and connected to a power cable (not shown). Further, the reflector fixture 32 is fixedly installed at the central portion of the safety net 31 coupled to the reflector 30 so that it is directed toward the reflector 30, and the auxiliary reflector 60 is fixedly installed to the reflector fixture 32 in such a manner that the concave surface thereof is directed toward the reflector 30. Of course, the auxiliary reflector 60 is installed not to come into contact with the central front end of the halogen lamp 40. Then, if the power switch is turned on by using a control knob 35, the electric power is applied to the halogen lamp 40 to cause the heat to be generated from the halogen lamp 40. Heat rays emitted from the lamp (for example, H1) are primarily reflected on the reflector 30 and then transferred to a user, whereas the other heat rays (for example, H2) are primarily reflected on the auxiliary reflector 60 and secondarily reflected on the reflector 30 and then transferred to the user. That is, contrary to the electric heater shown in FIG. 2 in which only the primarily reflected heat rays are emitted, all the heat rays including secondarily reflected components thereof by the auxiliary reflector 60 are reflected on the reflector 30 and emitted in case of the electric heater shown in FIGS. 3 to 5. Therefore, since the amount of heat to be reflected and transferred to the user is remarkably increased, heating efficiency can be relatively improved.

Moreover, since the auxiliary reflector 60 is installed in front of the halogen lamp 40, there is an advantage in that children cannot bring pointed objects (for example, chopsticks) into direct contact with the lamp so that the lamp can be protected. Further, since the halogen lamp fixing plate 50 is designed to have a low height thereof, it can be fixed almost integrally to the reflector 30 and thus easily installed. Since the fixing plate 50 does not hinder a heat transfer process, the heating efficiency of the electric heater can be enhanced. However, in a case where such a type of electric heater is employed, radiant heat resulting from the reflected heat may be locally concentrated on an upper periphery the reflector 30. In such a case, the children may burn their delicate skin on the hot upper periphery of the reflector.

Accordingly, an electric heater disclosed in Korean Utility Model Registration No. 236788 has been developed. FIG. 5 is a front view of the electric heater with a conventional heat shield plate mounted thereto, and FIG. 6 is a sectional view taken along line B—B of FIG. 5. The electric heater also comprises the halogen lamp fixing plate 50 with the fixing holes 51 (not shown) for allowing the electrical power to be supplied to the halogen lamp 40 and fixing the halogen lamp 40 horizontally, the auxiliary curved reflector 60 installed to correspond to the central bent portion of the halogen lamp 40 for causing the heat to be reflected onto the reflector 30, and the reflector fixture 32 of which one end is connected to the auxiliary reflector 60 and the other end is fixed to the central portion of the safety net 31. Further, a heat shield plate 70 for shielding the radiant heat toward the upper periphery is installed at an upper edge of the reflector 30, and a ceramic coating layer 71 for increasing heat shield efficiency is also formed on a surface of the heat shield plate facing the lamp. The heat shield plate 70 is provided at a proper position of a top portion thereof with protruding portions 72 in which screw holes 73 for fixing the heat shield plate to the upper edge of the reflector 30 are formed, and thus, the heat shield plate is fixedly coupled to the reflector 30 with screws 74.

As described above, according to the previous electric heater, heat rays H3 shown in FIG. 6 directed toward the upper periphery of the reflector 30 cause the upper periphery to be heated. Thus, the children may burn their delicate skin on the hot upper periphery of the reflector. However, according to the electric heater shown in FIGS. 5, 6 and 6A, since the radiant heat rays H3 directed toward the upper periphery of the reflector 30 are reflected onto the coating layer 71 of the heat shield plate 70, the radiant heat directed toward the upper periphery is completely blocked. Thus, since heat transfer locally concentrated on the upper periphery P of the reflector 30 is prevented, overheating of the upper periphery P can also be prevented. Moreover, since the heat-resistant coating layer 71 is formed on a bottom surface of the heat shield plate 70 so that heat transfer efficiency can be decreased, heat shield efficiency of the heat shield plate 70 can be improved. In such a case, it is preferred that the heat-resistant coating layer 71 be made of ceramic since the ceramic exhibits the heat-resistant characteristics even at a temperature of 350° C. However, according to such a constitution, the heat transferred through the reflector 30 cannot be still blocked even though the heat-resistant coating layer 71 blocks the radiating heat. Further, since the heat shield plate 70 is horizontally placed, a kind of space for additionally accommodating heat therein is defined. Thus, since the space may produce another factor in overheating of any specific portions on the reflector, there is a further problem in that a desired heat shield effect cannot be easily achieved.

SUMMARY OF THE INVENTION

The present invention is conceived to solve the problems in the prior art. An object of the present invention is to provide an electric heater with a heat shield plate capable of being self-cooled, wherein heat cannot be transferred to an upper periphery of a heat reflector by installing the heat shield plate at an upper edge of the reflector of the heater and the heat can be circulated via a plurality of through-holes formed in the heat shield plate.

To this end, the present invention is configured such that the heat shield plate is installed at the upper edge of the reflector of the heater and a plurality of through-holes are dispersedly formed in the heat shield plate. Further, the heat shield plate is fixed to the reflector via fixing pieces thereof in such a manner that a predetermined space is defined by extension pieces of the heat shield plate between the reflector and the heat shield plate.

According to one aspect of the present invention, there is provided an electric heater with a heat shield plate, including a heating body which is installed at a reflector and heated when electrical power is applied thereto, and a safety net which covers a front surface of the reflector and defines a space for accommodating the heating body therein. Further, the heat shield plate is installed at an upper edge of the reflector such that foreign materials are prevented from falling down onto the heating body through the safety net, and a plurality of through-holes are dispersedly formed in the heat shield plate in order to prevent the heat shield plate from being overheated.

The heat shield plate may include a curved strap-like plate in which the plurality of through-holes are dispersedly formed, and fixing pieces which extend vertically from the curved plate on one lateral side thereof so that they are coupled to the reflector.

Preferably, the fixing pieces and the curved plate are constructed to be connected with each other via extension pieces which extend from the curved plate in a width direction of the curved plate.

More preferably, the fixing pieces are dispersedly formed on at least two positions on the one lateral side of the curved plate, and an additional space is defined between the extension pieces connecting with the fixing pieces when the heat shield plate is coupled to the reflector.

BRIEF DESCRIPTION OF THE DRAWINGS

The above and other objects and features of the present invention will become apparent from the following description of a preferred embodiment given in conjunction with the accompanying drawings, in which:

FIG. 6 is a sectional view taken along line B—B of FIG. 5;

FIG. 6A is an enlarged view of the conventional heat shield plate shown in FIG. 6;

DETAILED DESCRIPTION OF THE PREFERRED EMBODIMENTS

Hereinafter, a preferred embodiment of the present invention will be described in detail with reference to the accompanying drawings.

Figure 1:
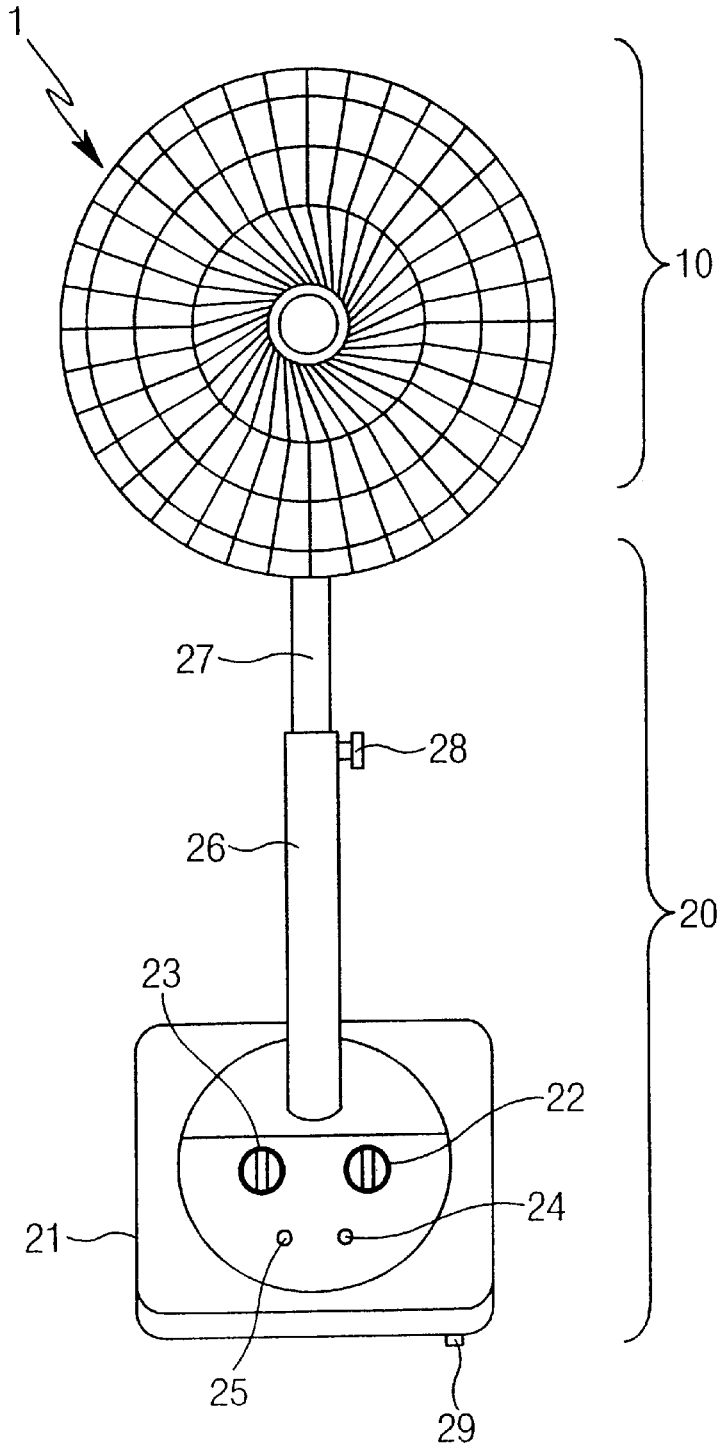
FIG. 1 PRIOR ART
FIG. 1 is a front view of a conventional electric heater.
Figure 2:
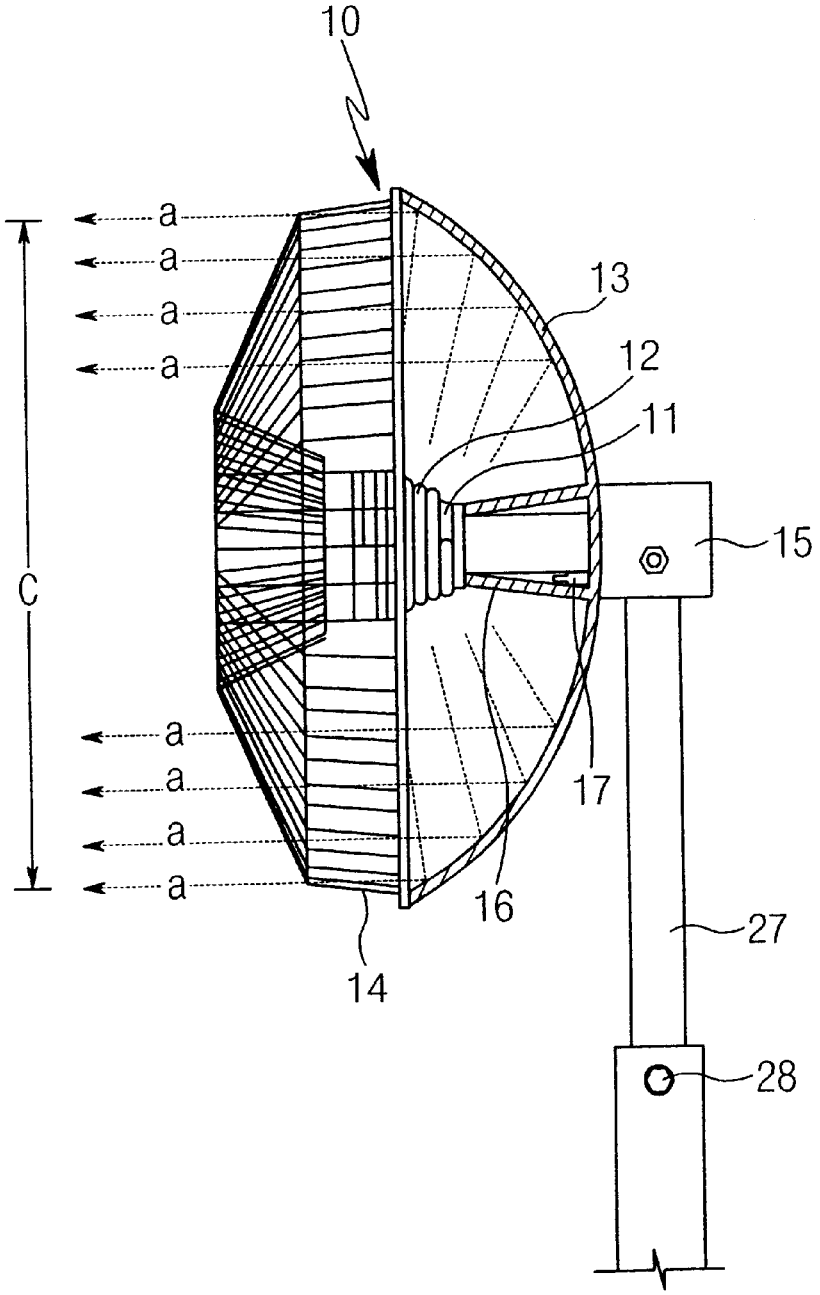
FIG. 2 PRIOR ART
FIG. 2 is an enlarged sectional view of essential components of FIG. 1.
Figure 3:
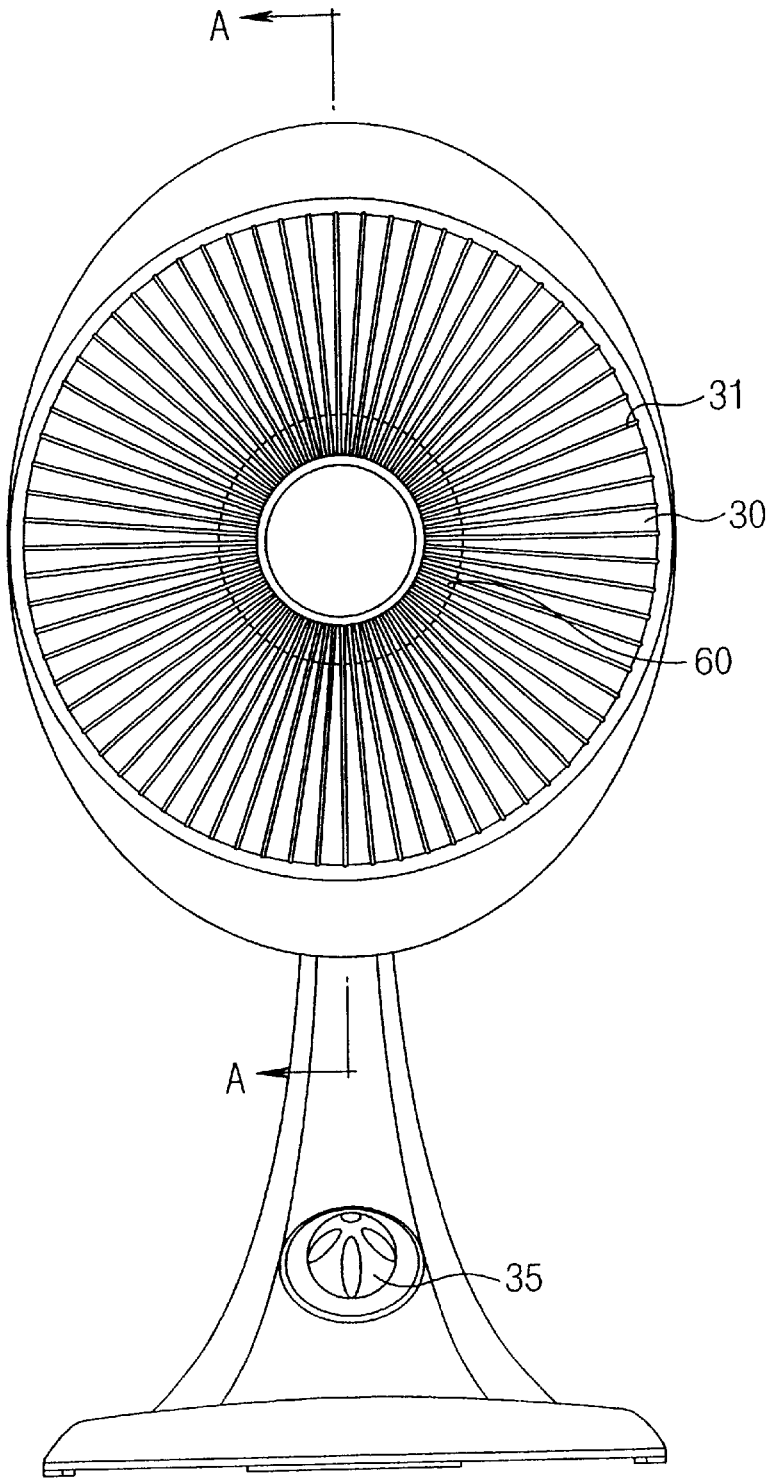
FIG.3 PRIOR ART
FIG. 3 is a front view of another conventional electric heater.
Figure 4:
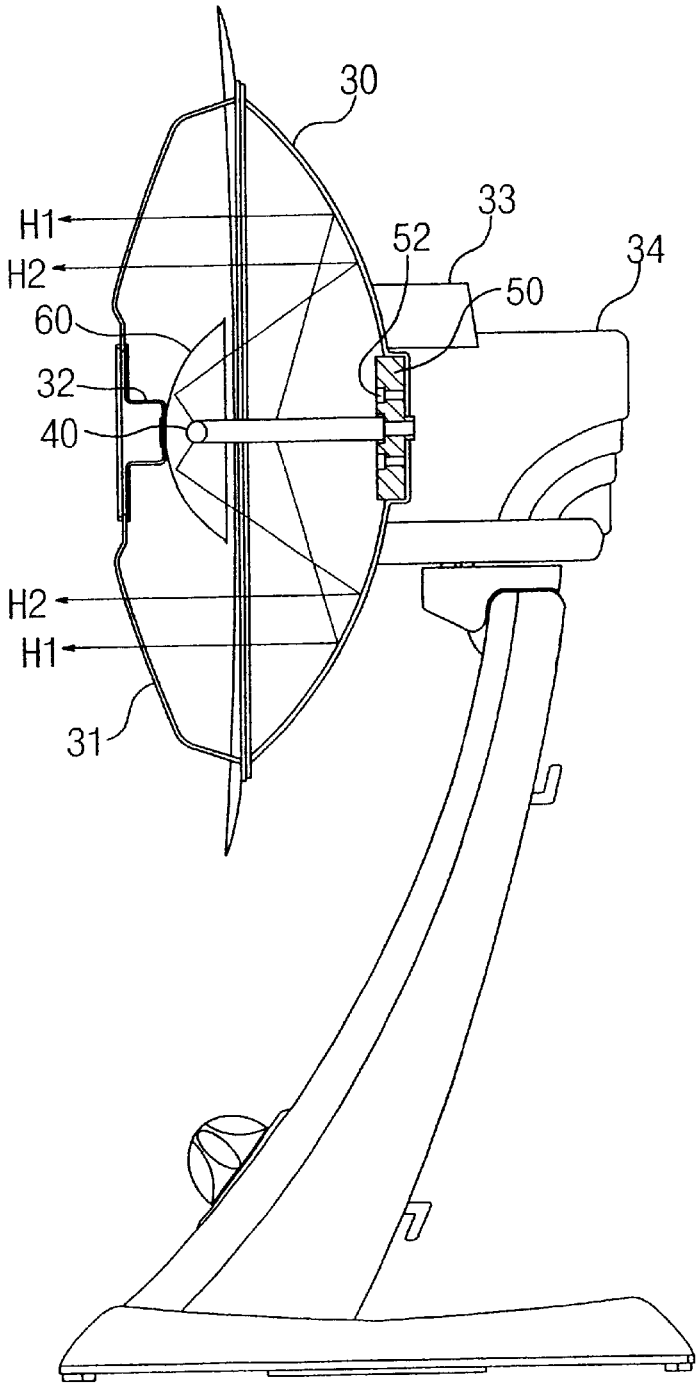
FIG. 4 PRIOR ART
FIG. 4 is a sectional view taken along line A—A of FIG. 3.
Figure 5:
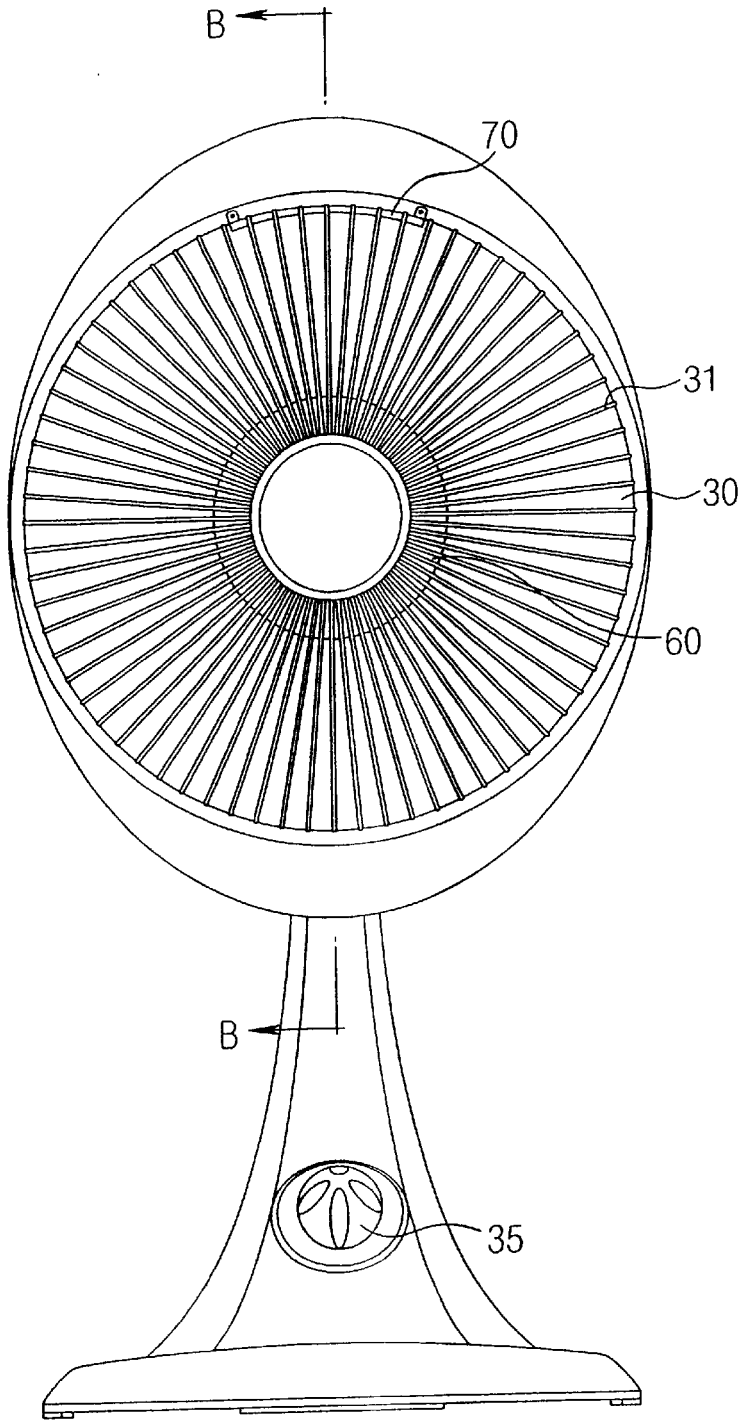
FIG.5 PRIOR ART
FIG. 5 is a front view of an electric heater with a conventional heat shield plate mounted thereto.
Figure 7:
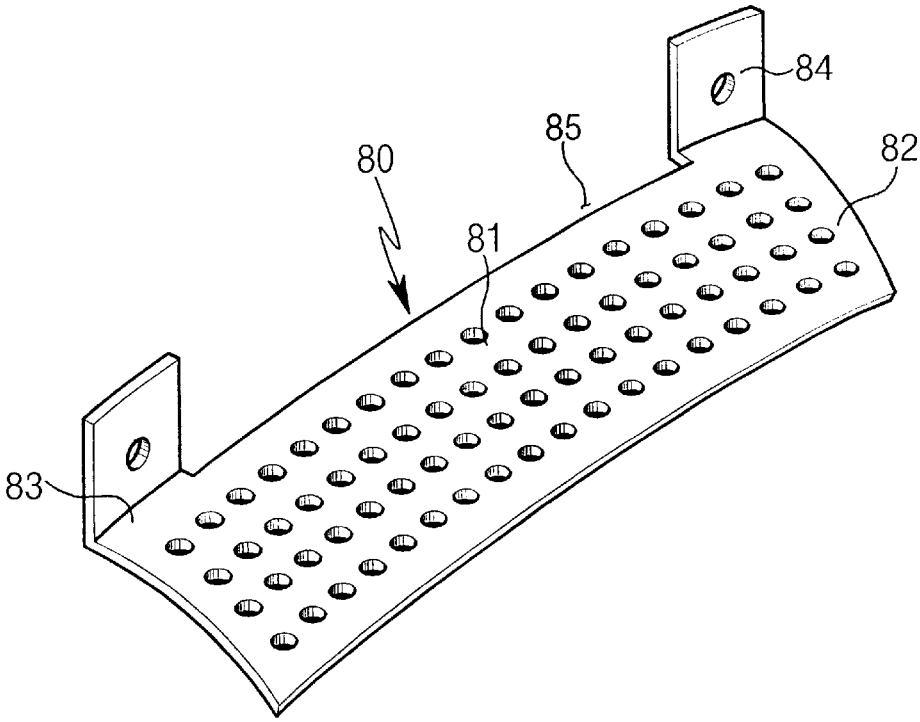
FIG. 7 is a perspective view of a heat shield plate for use in an electric heater according to the present invention.
Figure 8:
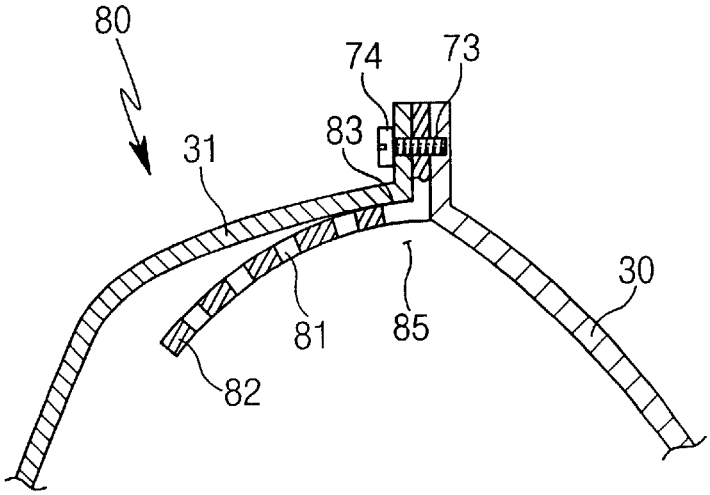
FIG. 8 is an enlarged sectional view of a major portion of the heat shield plate, showing a state where the heat shield plate is installed according to the present invention.

FIG. 7 is a perspective view of a heat shield plate for use in an electric heater according to the present invention, and FIG. 8 is a sectional view showing a state where the heat shield plate is installed according to the present invention. The electric heater of the present invention includes a heating body which is installed at a reflector 30 and heated when electrical power is applied thereto, and a safety net 31 which covers a front surface of the reflector and defines a space for accommodating the heating body therein. Further, a heat shield plate 80 is installed at an upper edge of the reflector 30 such that foreign materials are prevented from falling down onto the heating body through the safety net, and a plurality of through-holes 81 are also dispersedly formed in the heat shield plate 80 in order to prevent the heat shield plate from being overheated.

The heat shield plate 80 includes a curved strap-like plate 82 in which the plurality of through-holes 81 are dispersedly formed, and fixing pieces 84 which extend vertically from the curved plate 82 at both ends of one lateral side thereof so that they are coupled to the reflector 30.

Each of the fixing pieces 84 is bent with respect to the curved plate 82 with each corresponding extension piece 83 interposed therebetween. The fixing pieces 84 are dispersedly formed at two or more positions on the one lateral side of the curved plate 82, and the space 85 is defined between the respective extension pieces 83 connecting the heat shield plate 80 and the fixing pieces 84 when the curved plate 82 are coupled to the reflector 30.

In the present invention constructed as such, the reflector 30 and the safety net 31 are coupled to each other with screws 74 in a state where the heat shield plate 80 of FIG. 7 is interposed therebetween. In a case where they are directly coupled to each other without interposing the heat shield plate therebetween, the foreign materials (for example, fiber or fabric) fall down onto the heating source (or heating body) from the above and thus are burned. According to the present invention, however, the heat shield plate 80 prevents the foreign materials from falling down directly onto and coming into contact with the heating source so that a fire on the heating source can be prevented. Furthermore, since the plurality of through-holes 81 through which the heat passes upwardly are formed in the curved plate 82 of the heat shield plate 80, natural cooling of the heat shield plate through the through-holes 82 can be made and thus the overheating of the heat shield plate can be prevented. In addition, when the heat shield plate 80 is coupled to the reflector 30, the extension pieces 83 causes the space 85 to be defined in the heat shield plate 80 and thus heated air can be discharged even through the space 85. Therefore, heat concentration at and thence overheating of the heat shield plate can also be prevented. Moreover, since transfer of the radiant heat from the heating source is blocked by the heat shield plate 80, the upper periphery of the reflector cannot be overheated and thus any burn on the hand can also be prevented even though the user inadvertently touches the upper periphery. Although it has been described that the fixing pieces 84 are installed at both the ends of the lateral side of the heat shield plate, the present invention is not limited thereto but may be configured in such a manner that the fixing pieces are installed at any other or more positions if the additional space 85 can be defined in the heat shield plate.

As described above, according to the present invention, the heat shield plate with the plurality of through-holes is installed at the upper edge of the reflector of the electric heater so that the air passing through the holes can cool the heat shield plate. Further, the additional space is defined in the heat shield plate that is coupled to the reflector so that the generated heat cannot be collected therein. Thus, the local heating on the heat shield plate can be prevented. Further, since the heat shield plate blocks the heat rays from being directed toward the upper periphery of the reflector, the temperature of the upper periphery of the reflector is relatively lowered. Thus, the burn on the hand of the user can be prevented even though the user inadvertently touches the upper periphery of the reflector. Furthermore, since the heat shield plate prevents the foreign materials from falling down onto the heating source, and thus, the fire thereon can also be prevented.

Although the present invention has been described with respect to the preferred embodiment shown in the drawings, the present invention is not limited thereto. It will be apparent to those skilled in the art that various substitutions, changes and modifications can be made thereto without departing from the technical spirit and scope of the invention.

What is claimed is:

1. An electric heater with a heat shield plate, including a heating body which is installed at a reflector and heated when electrical power is applied thereto, and a safety net which covers a front surface of the reflector and defines a space for accommodating the heating body therein, wherein:

the heat shield plate is installed at an upper edge of the reflector such that foreign materials are prevented from falling down onto the heating body through the safety net; and a plurality of through-holes are dispersedly formed in the heat shield plate in order to prevent the heat shield plate from being overheated;

wherein the heat shield plate includes a curved strap-like plate in which the plurality of through-holes are dispersedly formed, and fixing pieces which extend vertically from the curved plate on one lateral side thereof so that they are coupled to the reflector; and wherein extension pieces extend from at least two positions on the one lateral side of the curved plate in a width direction thereof, and each of the fixing pieces coupled to the reflector is constructed to be bent from one end of each extension piece.

2. The electric heater as claimed in claim 1, wherein an additional space is defined in the curved plate between the extension pieces connecting with the fixing pieces when the heat shield plate is coupled to the reflector.

* * * * *